United States Patent [19]

Mathewes et al.

[11] Patent Number: 4,576,088

[45] Date of Patent: Mar. 18, 1986

[54] PRESSURE-WAVE PROTECTIVE FLAP (OR DAMPER)

[75] Inventors: Wolfgang Mathewes, Giessen; Klaus Fitzner, Betzdorf; Uwe Plitt, Kirchen, all of Fed. Rep. of Germany

[73] Assignee: Kraftwerk Union Aktiengesellschaft, Mülheim an der Ruhr, Fed. Rep. of Germany

[21] Appl. No.: 558,032

[22] PCT Filed: Mar. 29, 1983

[86] PCT No.: PCT/DE83/00061

§ 371 Date: Nov. 21, 1983

§ 102(e) Date: Nov. 21, 1983

[87] PCT Pub. No.: WO83/03462

PCT Pub. Date: Oct. 13, 1983

[30] Foreign Application Priority Data

Mar. 29, 1982 [DE] Fed. Rep. of Germany ... 8208932[U]

[51] Int. Cl.[4] ..... F23L 17/00

[52] U.S. Cl. ..... 98/119; 49/31; 98/32

[58] Field of Search ..... 98/119, 32, 74, 37; 49/31, 135

[56] References Cited

U.S. PATENT DOCUMENTS

| | | | |
|---|---|---|---|
| 2,965,014 | 12/1960 | Lowery | 98/119 |
| 3,301,168 | 1/1967 | Schindler | 98/32 |
| 4,167,898 | 9/1979 | Barcant | 98/32 |

FOREIGN PATENT DOCUMENTS

| | | | |
|---|---|---|---|
| 111286 | 7/1944 | Denmark | 98/119 |
| 1227345 | 10/1966 | Fed. Rep. of Germany | 98/32 |
| 7133893 | 11/1972 | Fed. Rep. of Germany | 98/32 |
| 2839998 | 4/1980 | Fed. Rep. of Germany | 98/119 |
| 473957 | 7/1969 | Switzerland | 98/32 |
| 569013 | 5/1945 | United Kingdom | 98/32 |

*Primary Examiner*—Henry Bennett

*Attorney, Agent, or Firm*—Herbert L. Lerner; Laurence A. Greenberg

[57] ABSTRACT

Damper for the protection of equipment, through which a gaseous or vaporous medium, particularly air, flows, against pressure waves, particularly in ventilation and/or air conditioning installations for the protection of the components of the plant, its internals and ducts, consisting of a frame structure and a multiplicity of slats (15) which are supported therein hinged about parallel axes and in one plane and which are held in their open position by restoring forces and are braced against stops. Special features are: the individual slats (15) consist of approximately flat strips which are hinged about respective axes extending in the region of their one longitudinal edge, and the slats (15) are followed in the pressure surge direction (22) of the medium by a support grid (5) which is fastened to the frame structure, covers the base area of the slat arrangement, the grid bars (9, 7) of which, arranged in a support raster, have a pitch matched to the width of the strips, and against which the slats (15), in their closed position, rest at least in a majority of support points distributed over their entire length.

33 Claims, 18 Drawing Figures

PRESSURE-WAVE PROTECTIVE FLAP (OR DAMPER)

The invention relates to a flap (or damper) or shutter for protecting against pressure waves equipment through which a gaseous or vaporous medium, particularly air, flows, according to the preamble of claim 1.

The components in ventilating and/or air conditioning plants, such as in particular, suspended-matter filters, but also heat exchangers, dampers and component housings and ducts themselves, must be protected from destruction by pressure waves and/or increased air velocity. A special problem, in this regard, is the response speed of the flap; the latter ought to have closed without any possibility of destruction of the components to be protected. Pressure wave protective flaps have particular importance in the supply and exhaust system of nuclear power stations. The inlet air may flow into the containment only in filtered condition and may leave the containment as exhaust air likewise only filtered. An exhaust air purification and filter system is described, for instance, in German Pat. No. 26 25 275; it has a multiplicity of suspended-matter filters 10 which are preceded and followed, respectively, by activated carbon filters 6, 13, and it includes further post-filters 15 which are connected to the activated carbon filters post-connected in the direction towards the exhaust-air chimney 18.

From British Pat. No. 569,013, a pressure wave protective flap of the type mentioned at the introduction hereto is known having a frame which can be mounted in a ventilating duct and to which slats, constructed as articulated flaps with V-shaped cross section and a swivel axis at the vertex, are, independently of each other, supported rotatably, about several mutually parallel axes and which, when a given air velocity is exceeded and/or in the case of increased air pressure, are acted upon, in the direction of closing and thereby close off the duct cross section automatically until the air velocity and/or the air pressure have dropped to normal value.

A V-shaped cross section is also shown by the articulated flap-like slats according to German Utility Model (DE-GM) 7 133 893 which relates to a ventilation window for housings of exposed transformer stations. In order to avoid the escape of hot or even burning gases through the ventilating window to the outside in the case of a short circuit, the articulated flap-like slats are supported on the narrow sides thereof by means of bearing pins in bearing holes of the frame in such a manner that they are swung by the internal excess pressure into a closed position, wherein they overlap each other. To avoid vibration or chattering of the free-swingingly suspended flaps, due to external influences, for instance, vibrations or also changing air pressure, the exposed edges of these articulating flap-like slats can be restoringly spring-loaded by a yielding force, specifically springs. Strip-shaped extensions of elastic plastic material at end-face plates having the bearing pins serve as the springs. It is, in particular, a disadvantage of these two known embodiments of protective pressure-wave flaps, that the individual slats exhibit complicated profiles and consequently have a considerable structural width as well as a relatively large weight. In the event of the occurrence of pressure-waves and increased air velocities, the reaction of the slats is therefore relatively sluggish. These known protective pressure-wave flaps are therefore not usable if the purpose is to protect sensitive components in ventilating and air conditioning installations such as suspended-matter filters, for example, spontaneously against mechanical destruction by occurring pressure-waves and increased air velocity. Such conditions prevail in particular, as already explained above, in nuclear power stations, the containment of which is ventilated via duct system; such conditions prevail if a defect in the pressure system of the containment occurs. Conventional overpressure protective flaps are relatively sluggish; they close generally only when an overpressure of 1.3 bar is built-up, which is sufficient to destroy the sensitive suspended-matter filters. So-called surge valves respond more rapidly; generally they have a closing time in the order of magnitude of 100 ms, but they are sensitive to contamination, whereby the closing time becomes longer again.

It is a general object of the instant invention to provide a protective pressure-wave flap according to the generic definition, by which protection of the installation components requiring protection against pressure-waves and excessive air velocity, is afforded with a faster response speed or shorter response time than in the known protective pressure-wave flaps. Particularly, the problem arises to construct a protective pressure-wave flap according to the generic definition in such a way that

- closing times (i.e., the time difference between arrival of the pressure-wave at the slats and the closing thereof are attained which are below 20 ms and preferably even equal to or shorter than 10 ms;
- reliable response of the flap is assured down to the pressure increase rates of 0.1 bar/sec;
- response of the flap is assured at pressure increase rates in the range of 0.01 bar/sec ($10^3$ Pa/sec) within the scope of an even more specialized objective;
- the so-called fluttering of the flap or the slats thereof is avoided, within the scope of a further special objective, specifically in the range of small as well as large pressure change rates;
- the protective pressure-wave flap provides not only protection against pressure-waves of the same direction as the normal direction of flow, but can also serve as a check valve for preventing a reversal of the flow, by shutting off a back flow directed against the normal flow; and
- reliable protection of the suspended-matter filter in filter facilities of nuclear power stations against pressure-waves and against high air velocity is assured within the scope of a further special problem feature.

According to the invention, the stated problem is solved with a protective pressure-wave flap according to the generic definition mainly by the features presented in the characteristic part of claim 1, and, in detail, as well as in further embodiments, by the features presented in subclaims 2 to 38.

The advantages obtainable with the invention are in particular that the individual slat can be made of relatively thin and narrow material, and therefore of light weight. They therefore respond very easily and quickly to pressure-waves and increased air velocities and, due to the special support structure of the following support grid, provide in their closed position a stable closure of the duct cross section ahead of the system region to be protected. A preferred grid construction is presented in claim 5 with mutually crossing, horizontally and vertically extending grid bars of two grid bar groups. The individual slats can swing preferably about horizontal axes; they are braced in the closed position thereof particularly overlappingly against an adjoining lamination with an overlap range of, for instance, 3 mm and, together with the adjacent slat, which they overlap, against the appertaining horizontal grid bar. On the length thereof, however, the laminations are simultaneously supported and supportable, respectively, by the vertical grid bars, so that also light-weight slats can withstand large pressure differences. The invention also includes other grid configurations which are covered by claim 1 or subclaim 2 to 4 and will be explained briefly further hereinafter within the framework of the description of the figures; however, the orthogonal crossed-bar grid is the preferred embodiment.

For generating the restoring forces for the slats, leaf springs have been found to be advantageous in an arrangement such as is expressed in claim 13. Leaf springs are able to be manufactured with a very small mass; the mass thereof is negligibly small in comparison to that of the slats so that the response or closing time of the flap according to the invention is not appreciably increased by the leaf springs engaging the slats. An advantageous number of leaf springs is at least two per slat, an individual leaf spring having a width (dimension in the longitudinal direction of the slat), which amounts to about $\frac{1}{3}$ to all of the division and spacing, respectively, of the vertical crossed-grid bars. The restoring torque of the leaf springs must be large enough to overcompensate the torque of the pressure forces of the normal gas flow acting in the direction of closing. With a closing time of about 10 ms and a pressure increase of 0.1 bar/sec overpressure, the flap will have closed consequently at a pressure of 0.015 bar, corresponding to $1.5\times10^3$ Pa, if it is assumed that the forces of the restoring springs are just compensated at an overpressure of 500 Pa. This, however, is only an example; the restoring torque of the leaf spring can also be chosen smaller as well as larger, depending on the type of application of the flap.

Hereinafter, the invention will be explained in greater detail witn the aid of several embodiment examples of the invention. There is shown, in a partly simplified schematic view, in:

FIG. 1, a view on the protective pressure-wave flap or shutter, partly cut-away, as seen from the side of the slat array (pressure surge side);

FIG. 2, a vertical section through the protective pressure-wave flap according to FIG. 1;

FIG. 3, a horizontal section through the protective pressure-wave flap according to FIG. 1;

FIG. 4, the detail, greatly enlarged and designated by IV in FIG. 2, FIGS. 1 to 4 representing the first embodiment example;

FIG. 5 shows a duct section of rectangular cross section with a built-in protective pressure-wave flap in the top plan view;

Figure 5:
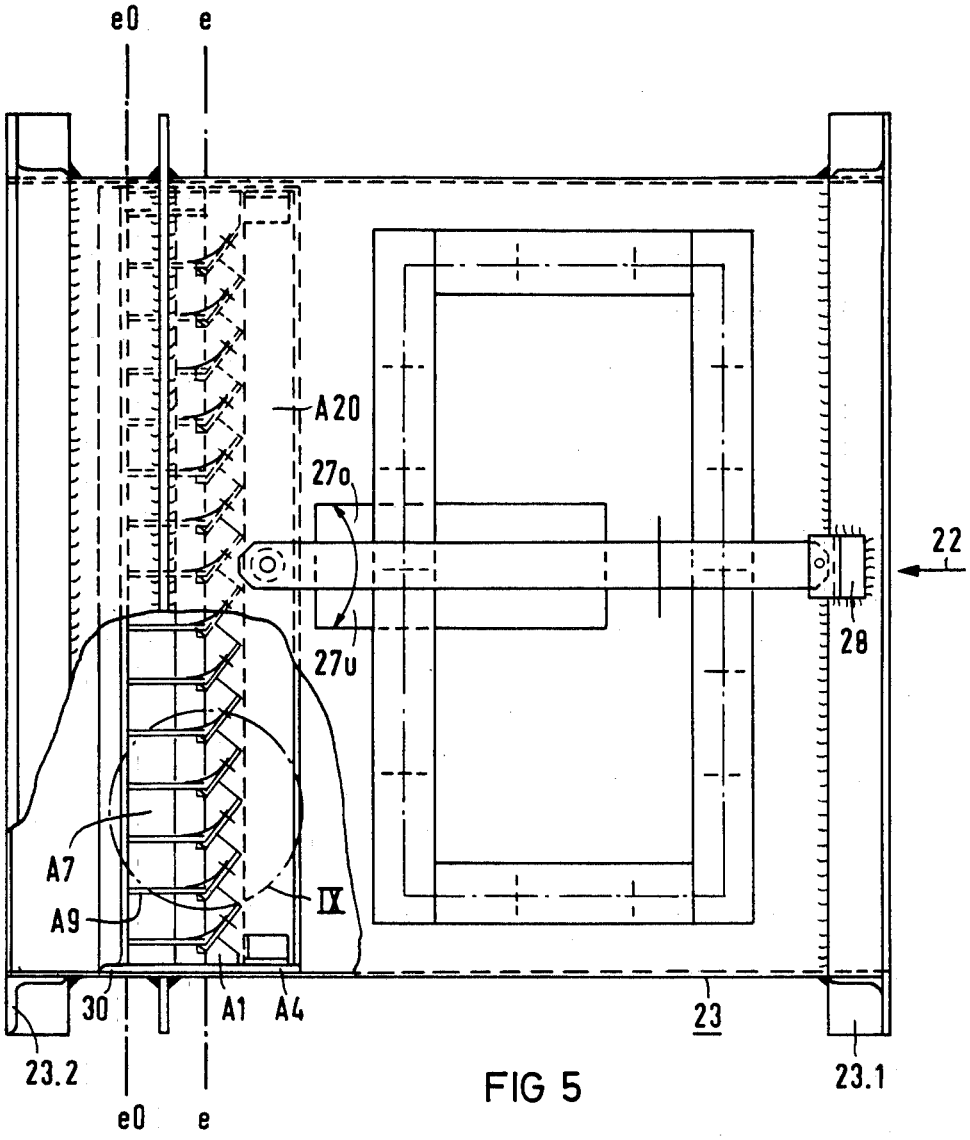
FIGS. 5 to 9 show a second embodiment example of the protective pressure-wave flap with a testing device for the operability of the slats, and a modified articulating support of the slats, and specifically.
Figure 6:
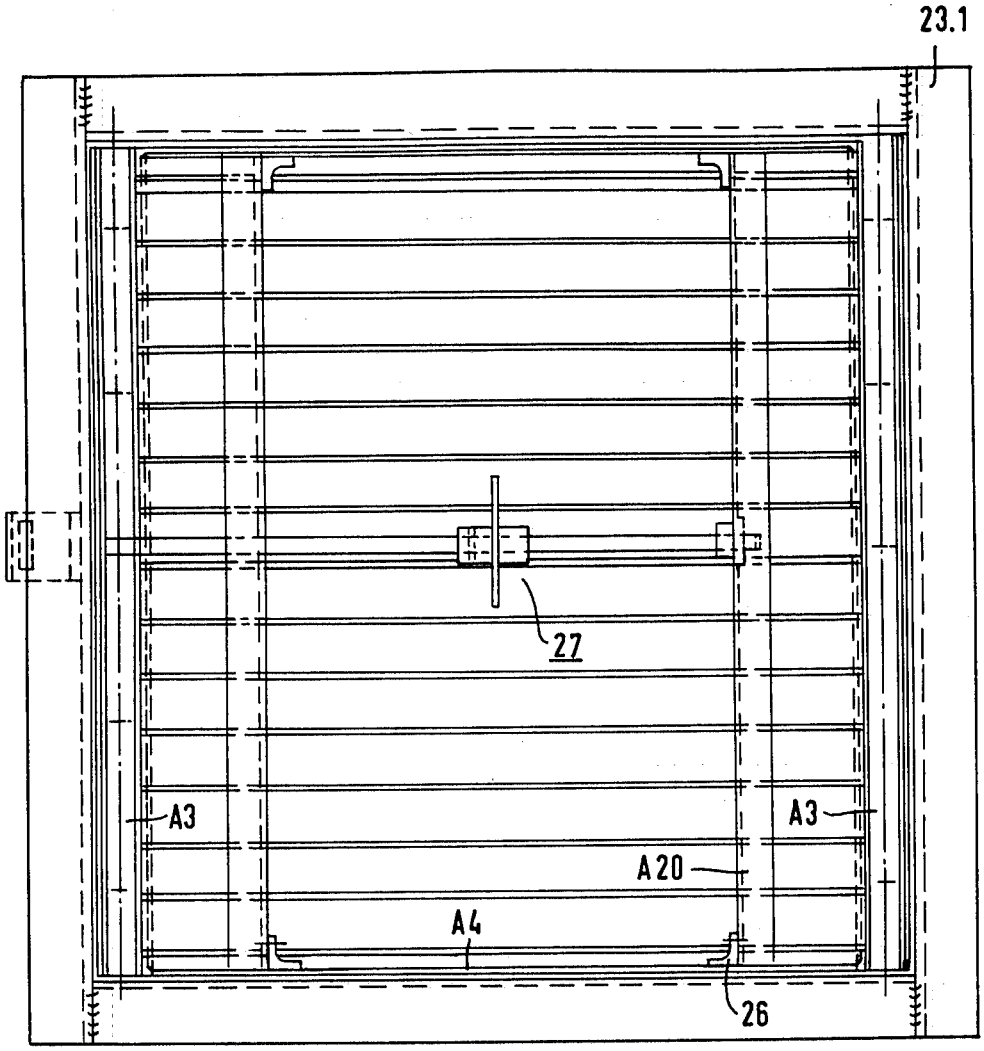
Figure 7:
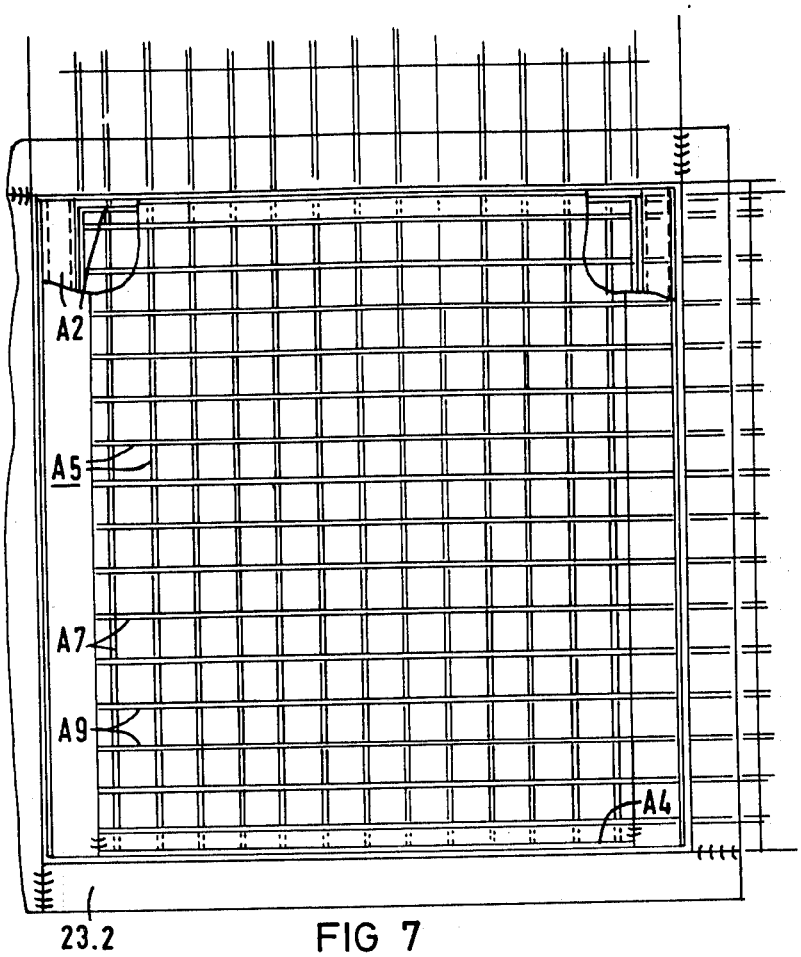
Figure 9:
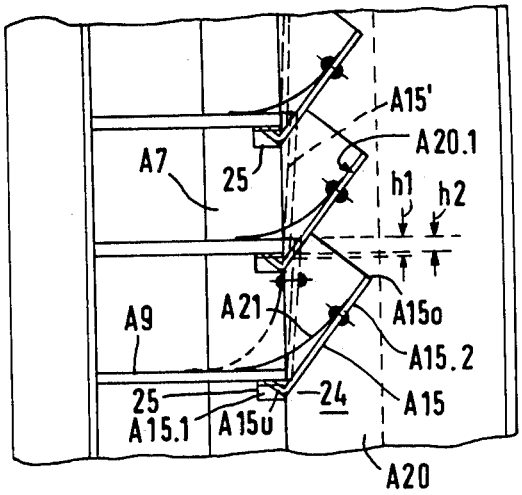
Figure 8:
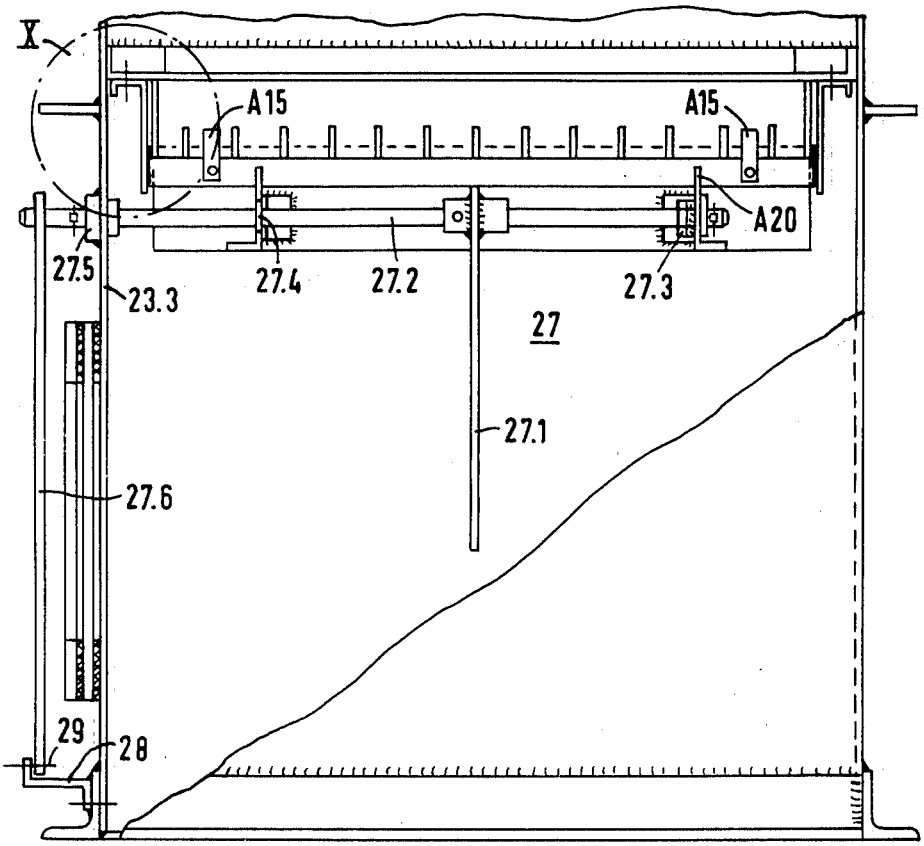
Figure 10:
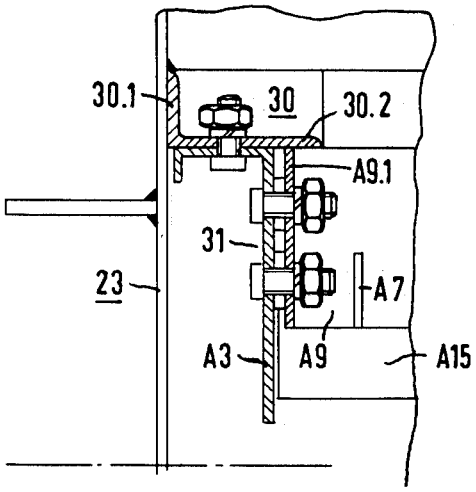
Figure 11:
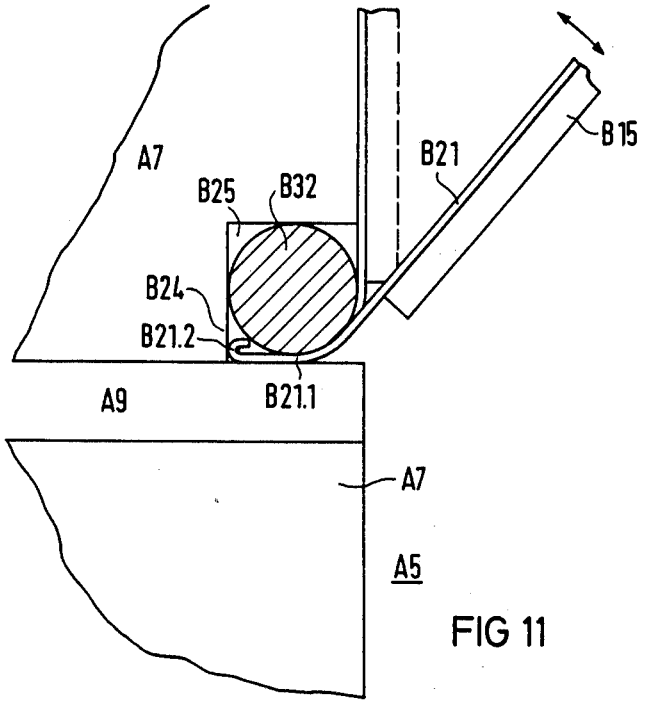
Figure 13:
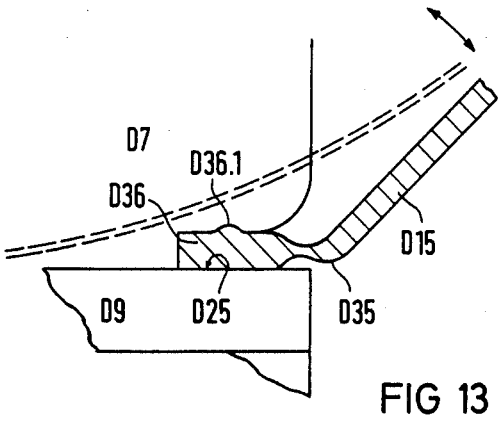
Figure 12:
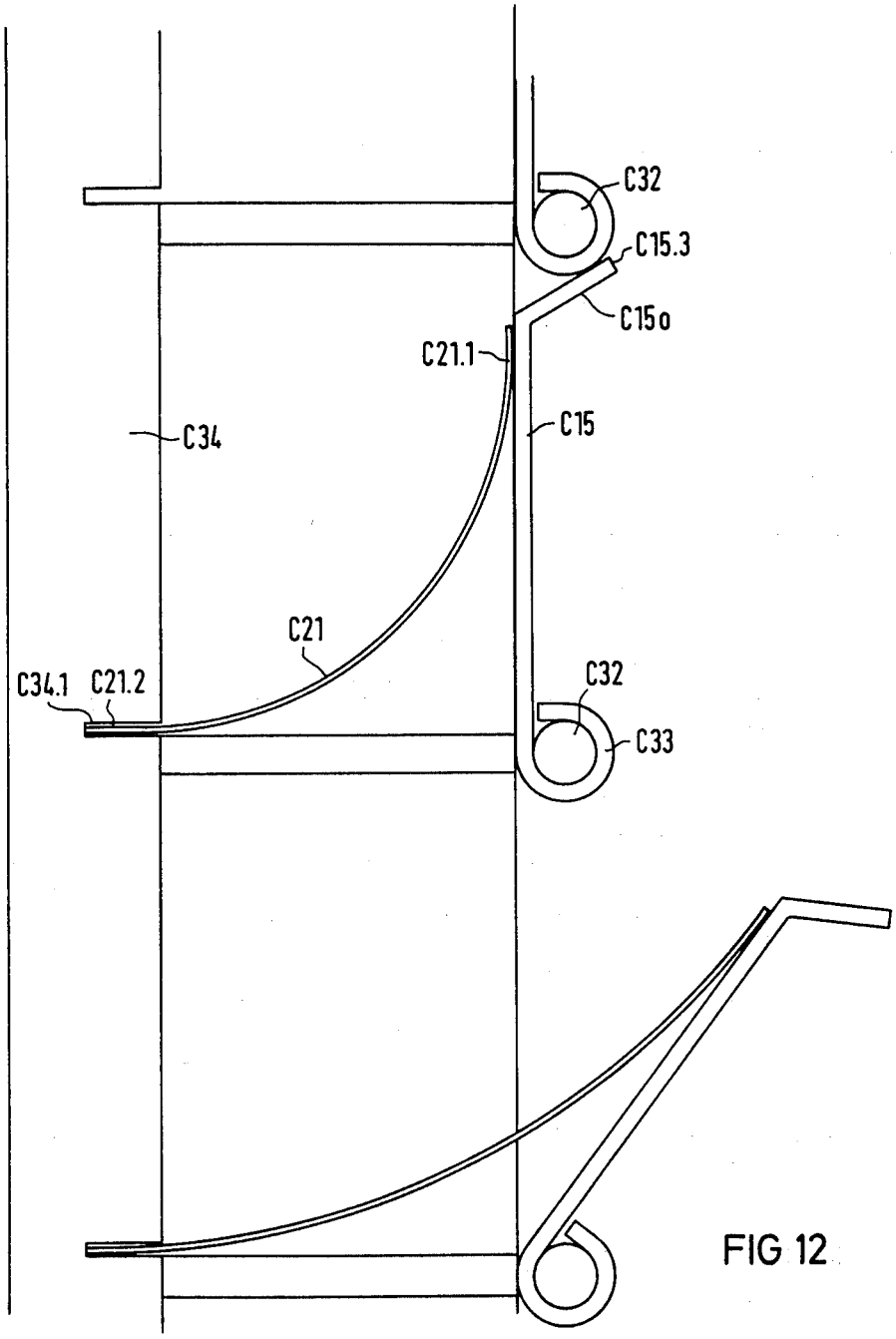
Figure 14:
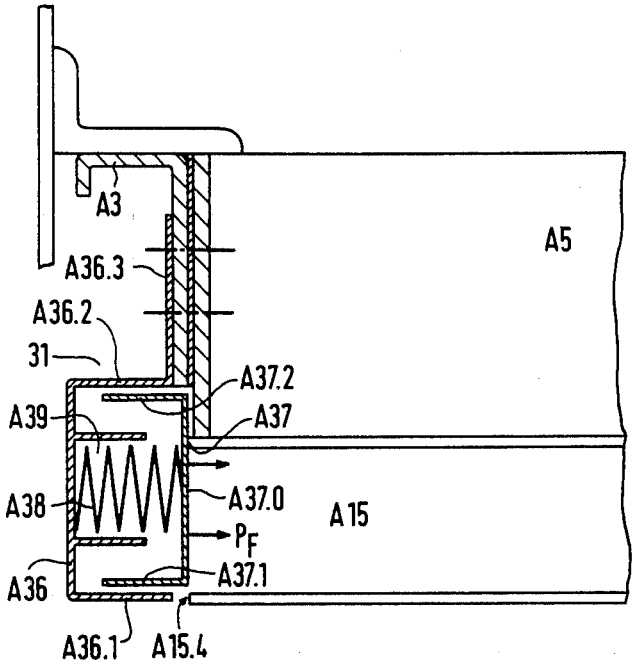
Figure 15:
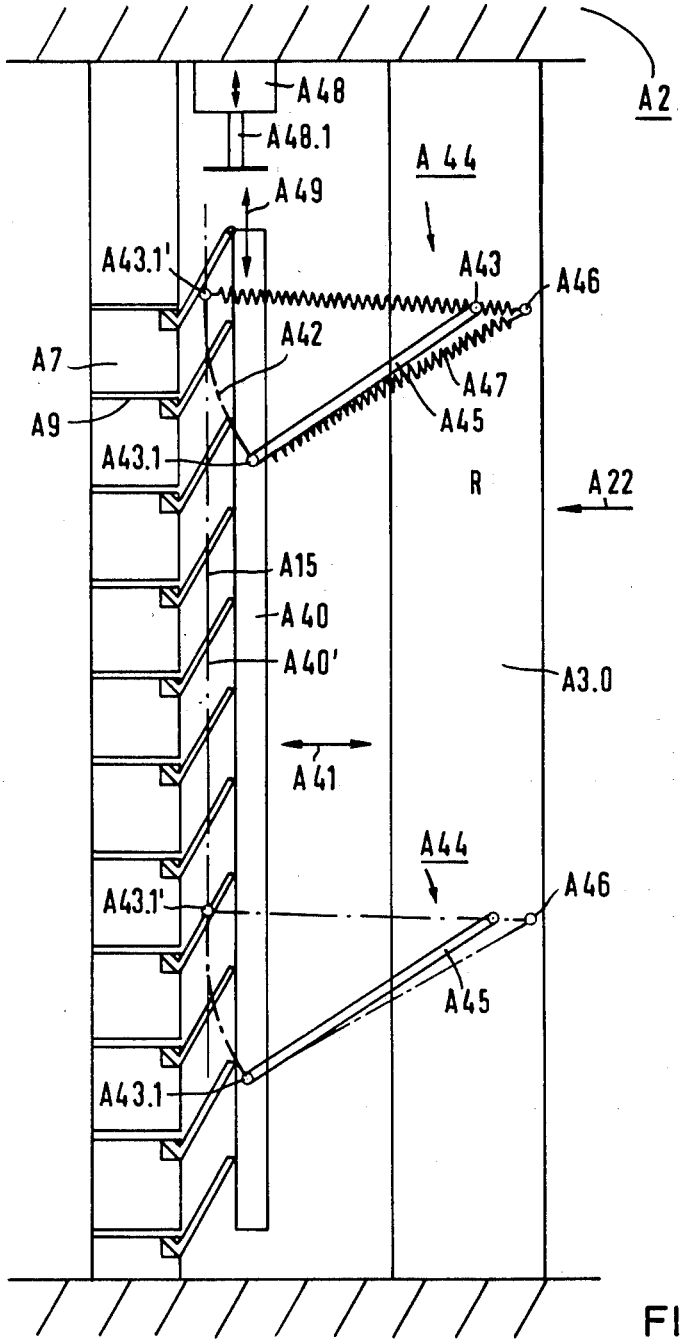
Figure 16:
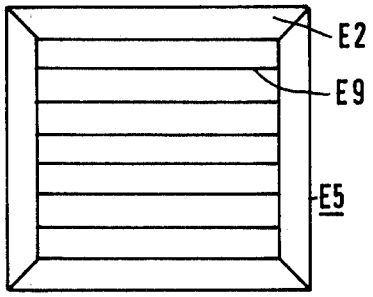
Figure 17:
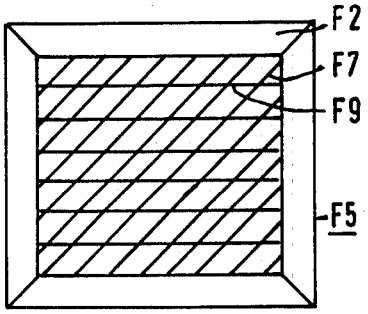
Figure 18:
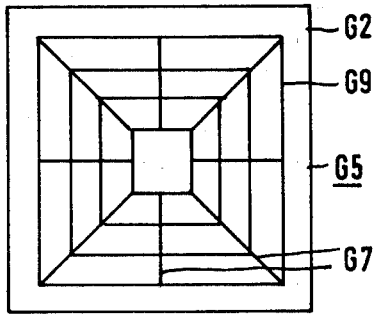

FIG. 6, a side view from the right (front view) of the arrangement according to FIG. 5;

FIG. 7, a side view from the left (rear view) of the arrangement according to FIG. 5, the presentation in FIGS. 5 and 7 being partly broken away;

FIG. 8, a top view, partly broken away, of the arrangement according to FIG. 5;

FIG. 9, the detail IX from FIG. 5, from which details of the support and re-setting of the slats can be seen;

FIG. 10, the detail X from FIG. 8, from which details of the protective flap frame and support grid construction can be seen;

FIG. 11, a third embodiment example for a slat support and resetting device, schematically;

FIG. 12, a fourth embodiment example for a slat support and resetting device, likewise schematically;

FIG. 13, a fifth embodiment example for a slat support and resetting device with laminations of a tough elastic plastic material, likewise schematically;

FIG. 14, an additional damping device which can be assigned to the two lateral sides of a slat array, in a simplified horizontal section. This structure belongs to the second embodiment example according to FIGS. 5 to 10 as a supplemental device;

FIG. 15, a further supplemental device in the form of a braking device which can be used for the first and second embodiment example according to FIGS. 1 to 4 and according to FIGS. 5 to 10, respectively, and is suitable, like the device according to FIG. 14, for preventing the protective flap or the slats thereof from fluttering when major pressure surges are shut off. FIG. 15 represents a top plan view as in FIGS. 2 and 5, however, more heavily schematized;

FIGS. 16 to 18, show different modifications and other configurations, respectively, of the grid panel, heavily simplified; and specifically, FIG. 16 shows a support grid formed of horizontal grid bars;

FIG. 17, a support grid formed of two groups of grid bars with different bar directions which cross at an obtuse and acute angle, respectively, forming rhombic-shaped grid panels; and FIG. 18, a support grid, formed of encircling bars disposed in rectangles or squares arranged concentrically to each other (first group of grid bars) and connecting bars disposed radially thereto (second group of bars). In all support grids and support grid panels, respectively, the grid bars are set on edge with respect to the direction of the pressure surge, in order to keep the flow resistance of the support grid panel as small as possible.

Figure 2:
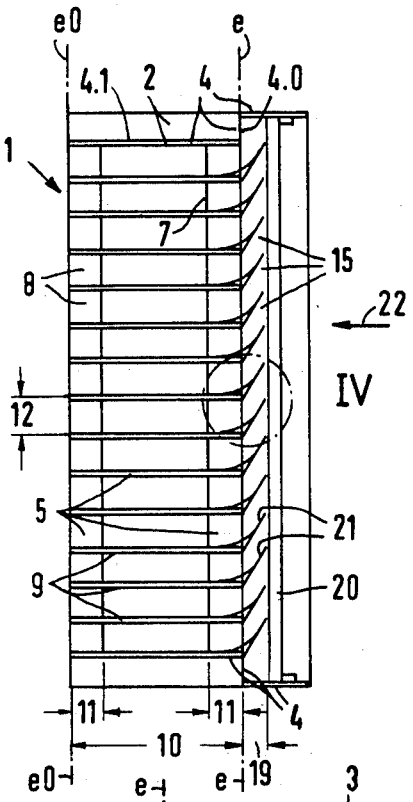

FIGS. 1 to 4 show a protective pressure-wave flap (or damper) or shutter 1 (called a protective flap for short hereinafter) for installation in or addition to ducts of ventilating and/or air conditioning plants. It is formed with (see, in particular, FIG. 1) a frame 2 composed of two vertical struts arranged mirror-symmetrically relative to each other, and two horizontal struts 4 which are likewise provided mirror-symmetrically relative to each other. All of the struts 3 and 4 are preferably made of sheet metal by bending, the struts 3 having a substantially C-shaped cross section (FIG. 3) and the struts 4 a substantially Z-shaped cross section (FIG. 2).

Into the area of the frame 2 bounded by the more closely disposed legs 1.4 of the horizontal struts 4, there is built a support grid 5 formed of vertical grid bars 7 and 8 as well as horizontal grid bars 9. All of the grid bars 7, 8 and 9 are formed of relatively thin sheet-metal, for instance, having a thickness between 1 and 3 mm. The depth of the support grid is defined by the width b of the horizontal grid bars 9; it corresponds to the depth of the frame section 10 determined by the more closely arranged legs of the horizontal struts 4. It is several times, for instance, six times larger than the respective width 11 of the respective vertical grid bars 7 and 8. In the embodiment example, the pitch 12 between adjacent horizontal grid bars 9 is chosen as equal to the pitch 13 between adjacent vertical grid bars 7, while the pitch 14 between adjacent vertical grid bars 8 (rear grid plane eO—eO) is triple the pitch spacings 12 and 13, respectively.

The outer longitudinal edge of the vertical grid bar 7 and the one longitudinal edge of the horizontal grid bars 9 lie on or in a common plane e—e which is again arranged flush with the Z-webs 4.0 of the horizontal struts 4 of the frame 2, see FIG. 2.

Figure 1:
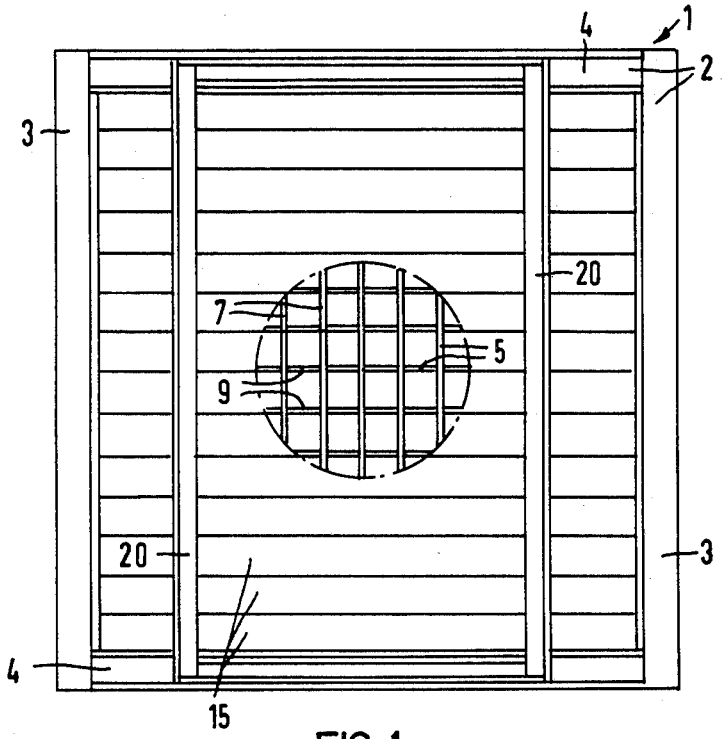
Figure 3:
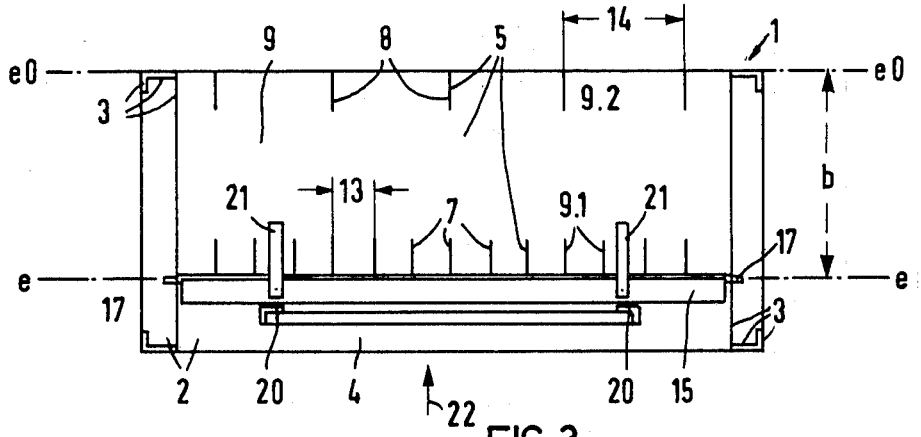

The outer long edge of the vertical grid bars 8 and the other long edge of the horizontal grid bars 9 are likewise arranged in a common plane eO—eO transverse to the flow and arranged flush with an end edge of the frame, see FIGS. 2, 3.

Immediately in front of the plane e—e of the support grid 5 coinciding with the flanges 4.0, a multiplicity of slats 15 are pivotally mounted in the vertical struts 3 of the frame 2. Each individual slat 15 is formed by a plane or, in the transverse direction, slightly bent (arched) sheetmetal strip, the width of which is made larger than the pitch 12 between two horizontal grid bars 9 by approximately the thickness of the material of a horizontal grid bar 9, so that, in the closed position, overlapping and covering, respectively, with the adjacent horizontal grid bar and the lower end of the adjacent lamination is assured. All of the slats 15 are swingable about mutually parallel horizontal axes, and specifically, can be tilted respectively about the lower long edge 16 thereof, and are supported between the vertical struts of the frame 2. To this end, the sheet metal strips forming the slats may be provided at the ends thereof with a formed-on projection 17 or an added-on pin, which extends into circular holes 18 located in the vertical struts 3 of the frame 2 at the height of the horizontal grid bars 9 of the support grid 5. The thickness of the material of the sheetmetal strips forming the laminations 15 is preferably chosen between 0.5 and 1.0 mm.

At a distance 19 in front of the plane e—e of the support grid 5 assigned to the slats 15, several (two in the example) vertical stop strips 20 are inserted between the legs of the horizontal struts 4 which are farther apart; the former have stop surfaces 20.1 for the slats 15, which are in tilted position. The distance 19 of the stop strips 20 from the aforementioned plane is preferably chosen so that the tilted slats 15 assume an angle $\alpha$ of 30° to 40° to the vertical (FIG. 4).

The upper side of each slat 15 is engaged in the vicinity of the free longitudinal edge thereof by several leaf springs 21 and, more specifically, so that they are effective in the plane of the stop strips 20. As indicated at 21.1 the leaf springs 21 are connected to the slats 15 in the vicinity of the free longitudinal edge of the latter by riveting or spot welding. With the other end thereof these leave springs 21 rest freely on the top side of the horizontal grid bar 9 which is adjacent to the respective tilting axis 16, 17; see, in particular, FIGS. 2 and 4. Each leaf spring 21 can be made of spring steel strip which, preferably, has a thickness of about 0.2 mm. The width of the steel spring strip, on the other hand, is chosen differently, depending on the desired spring force. Widths of between 20 and 30 mm have been found practical.

All parts of the protective flap 1 are advantageously made of non-rusting material, for instance, light metal, alloy steel or also titanium alloys. This recommendation for material applies to the slats 15 and also to the support grid including the frame structure thereof.

Figure 4:
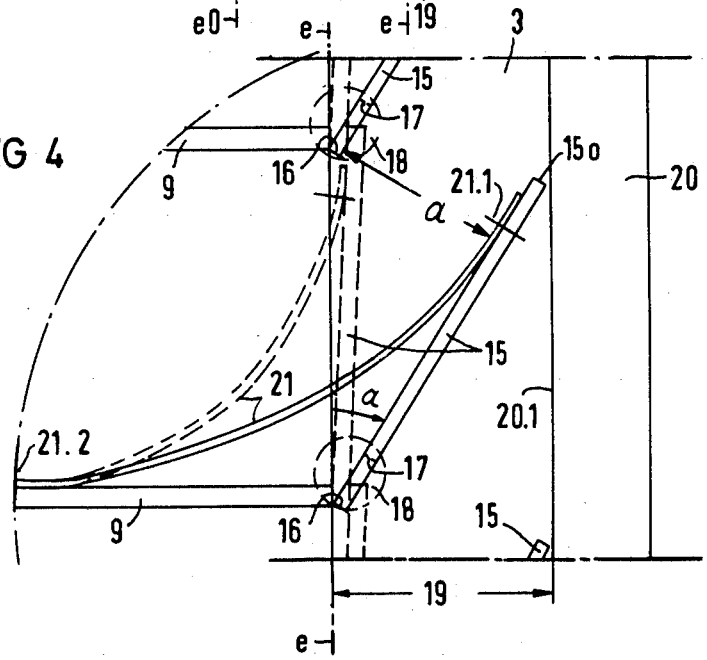

Normally, all slats 15 of the protective flap 1 are held by the leaf springs 21 in the tilted open position thereof which can be seen in FIG. 2 and by the solid lines of FIG. 4. The air then flows through the protective flap 1 in the direction of the arrow 22. For air velocities up to a limit velocity which is determined by the spring thickness of the leaf springs 21, the slats 15 remain in the tilted position thereof under the force of the leaf springs 21, and so, the protective flap 1 remains open.

If air velocities above the limit velocity occur, the slats 15 are pressed against the force of the leaf springs 21 into the broken-line position shown in FIG. 4 onto the seats thereof, and the protective flap 1 is closed thereby. In the event of pressure-waves in the order of magnitude of 1.25 bar, less than 6 ms closing times of the protective flap for this process could be achieved. In the closed position of the flaps 15, the support grid 5 absorbs the pressures acting thereon, the relatively small spacings between the individual grid bars 7 and 9 contributing to the fact that the slats 15 withstand the local pressure load in spite of the small thickness and light weight thereof.

It has been found important and advantageous that the horizontal grating bars 9, which are relatively wide i.e. have a great support grid depth, reduce the flow resistance of the protective flap 1 considerably. In order to form shock diffusors, the horizontal grid bars 9 have a dimension b in the flow direction 22 (see FIG. 3) which is several times the width a (see FIG. 4) of the narrowest flow cross section between adjacent slats 15, where this narrowest flow cross section corresponds to the smallest spacing of adjacent slats 15 in the open position thereof. The support grid depth b of the horizontal grid bars 9 must therefore be at least equal to, but preferably larger than, the support grid depth of the vertical grid bars 7, 8, and specifically, by several times.

As can be seen from FIGS. 2 and 3, the engagement of the grid bars is advantageously reciprocal by means of slots and webs, to construct a strong support grid panel. Thus, the horizontal grid bars 9, for instance, are provided with slots 9.1 (front side) and 9.2 (rear side) into which the vertical grid bars 7 and 8 are inserted. Advantageously, the arrangement can be made so that the depth of the slots 9.1 and 9.2 is only ½ the bar width of the vertical grid bars 7 and 8, respectively, and the latter are provided on half their width likewise with slots so that, in accordance with the so-called egg crate principle, a reciprocal form-locking engagement between slots of the one group of bars and webs of the other group of bars take place. For reasons of achieving a flow with as little loss as possible, and for obtaining a large resistance moment for intercepting the pressure forces acting on the slats, the grid bars are arranged on edge as seen in the flow direction 22.

The pitch 12 of the support grid 5 is matched, as mentioned, to the strip width of the slats; with smaller protective flaps and support grids, respectively, a support grid formed only of, for instance, horizontal grid bars or grid bars extending in only one direction would be sufficient for supporting the slats, always in the region of the two long edges thereof. For the relatively light-weight and flexible slats, it is necessary however, in the case of customary protective flaps with support grid side lengths in the order of magnitude of 500 mm or more, to equip the support grid not only with grid bars of the one direction but also with second grid bars crossing the first group of grid bars, whereby a multiplicity of additional support points distributed over the length of the slats, is obtained.

Starting out with the crossed grid panel of the first embodiment example according to FIGS. 1 to 4, it is advantageous in this connection if the division spacing or pitch 13 of the vertical grid bars 7 from each other is chosen so that it becomes smaller with increasing pressure load on the slats 15. In the example shown, it is, in particular, approximately equal to the pitch 12 between the horizontal grid bars 9 so that one can speak of a square support grid. If the pitch 13 were reduced even further with a greater pressure load, a rectangular support grid would be obtained with a larger number of support points which are formed by the vertical bars 7 and are accordingly distributed over the length of the slats.

In order to obtain a surface of the support grid 5 constructed of interleaved grid bars, which is as gap-free as possible, it is advantageous to provide the surface with a coating (not shown in detail), after the assembly. This coating can be applied, for instance, by spraying or immersion; it may be formed of a suitable plastic material or a coating metal such as zinc, or a varnish.

It is characteristic of the chosen, particularly advantageous slat resetting arrangement by means of leaf springs (see in particular FIG. 4), that the slats 15 have the free longitudinal edge 150 thereof inclined away from the support grid 5 and rest against a stop 20 or the stop surface 20.1 of the frame structure, and that, for generating a restoring torque about the tilting axis 16, 17 of the slats in the direction of the open position, on the support grid side of the slats in the vicinity of the long edge 150 thereof, the one respective end of the leaf spring 21, which is under pretension engages the one end which is supported with the other end thereof at a second force engagement point 21.2 of an adjacent grid bar 9. Of these two force engagement points 21.1 and 21.2, one is constructed as a spring fastener and the other as a spring sliding seat. The construction shown is particularly advantageous, wherein the leaf springs 21 is fastened to the slat at the respective one end at 21.1 and is slidingly guided with its other end on the thereto facing flat side of the adjacent horizontal grid bar 9 which extends parallel to the axis of the slat, i.e., the force engagement point 21.1 is the fastening point and the force engagement point 21.2 is the sliding spring seat. With this construction, a relatively small bending stress occurs during the closing process, which increases the service life and, in the case of aluminum slats 15, rubbing or sliding of the spring steel on the slat is avoided.

The protective flap construction according to the second embodiment example of FIGS. 5 to 10 corresponds basically so that according to the first embodiment example (FIGS. 1 to 4), the detail modifications being, however, explained in the following:

The protective flap A1 is installed in a duct section 23 which, as seen in the flow direction 22, has several times the depth of the protective flap A1. It is provided at both ends thereof with end flanges 23.1 and 23.2, by which it can be flanged to ducts or components of the ventilating and air conditioning plant, respectively. The parts which are the same as in the first embodiment example are designated, in FIGS. 5 to 10, with the same arabic numerals but are preceded by the capital letter A. It is seen that the support grid (FIG. 7) designated as a whole by A5 is formed somewhat shorter or less deep between the two planes e—e thereof (inflow side) and eO—eO (outflow side) than the support grid according to the first embodiment example, so that only one kind of vertical grid bars 7A is used. A considerable modification can be seen in FIGS. 5 and 9: the slats A15 are linked in the vicinity of their long sides A15u thereof near the tilting axis to the support grid A5, at least in a majority of joints 24 distributed over the length thereof. In the example shown, wherein thirteen vertical grid bars A7 are used, thirteen joints of the type shown in detail in FIG. 9 also could accordingly by used per slat A15. In detail, these are constructed so that the slats A15 are angled off at the long sides A15u thereof near the tilting axis, as shown, the angled-off portion A15.1 (short leg) amounting to approximately 1/10th to 1/5th of the length of the longer lamination leg A15.1. With these angled-off portions A15.1, the laminations A15 engage in slot-shaped recesses 25 of grid bars A7 which extend transversely to the slats and are also vertical in the example shown, guided tiltably in the manner of knife edge bearings. Corresponding to FIG. 4, the enclosed position of the slats A15 is indicated in broken lines also in FIG. 9; in the closed position A15', the angled-off portion A15.1 rests against the underside of the horizontal grid bars A9, and the longer lamination leg A15.1 overlaps the adjacent slat arranged on top thereof along the distance h1 and, with the edge of the corresponding horizontal grid bar, along the distance h2. Thus, two articulating points are obtained for the slat A15 within the slot-shaped recess 25 in the open position; the tilting support is supplemented by the leaf spring arrangement A21 which corresponds to that according to FIG. 4, and by the stop strip A20 which in this embodiment example has stop surfaces A20.1 which are formed by sawtooth-shaped recesses at the stop strip A20, and the inclination of which corresponds to the desired tilting angle $\alpha$ (see FIG. 4) of the slats, so that a large-area contact and support of the slats A15 is obtained in the open position shown.

In an arrangement similar to the first embodiment example, two stop strips A20 are also provided, which are firmly connected to the grid frame A2 and are arranged with the narrow sides thereof pointing in the flow direction A22 as well as in front of the slat arrangement or panel as seen in the direction of the pressure surge (see also FIGS. 5, 6 and 8). These stop strips are constructed as angle strips which are bolted at the upper and lower ends thereof (see FIGS. 6 and 8) to fastening angles 26 which are welded firmly to the horizontal frame struts A4. The vertical stop flanges A20 simultaneously serve for the support of a test device, identified in its entirety by 27, for the closing function of the slats A15. In detail, the test device 27 (see FIGS. 5, 6 and 8) is provided with at least one knife-like adjusting member 27.1 of low flow resistance, which is oriented in the flow direction and is pivoted parallel to the axis of the slats and somewhat in the middle of the slat array or panel, on the pressure surge side thereof, in such a manner that the upper side or the lower side of the slat array or panel can be closed by tilting this adjusting member 27.1 in the one or the other tilting direction **27*o* (upwardly) or 27*u* (downwardly). As can be seen, the stop flanges A20 serve for the rotatable support of the shaft 27.2 of the knife-shaped adusting member 27.1; for the purpose, they are provided with suitable bearing bushings 27.3 or feedthroughs 27.4**. A further bearing bushing with a shaft feedthrough is shown at the wall 23.3 of the duct section 23 at 27.5. This bearing bushing is welded to the wall of the duct. The shaft 27.2 leads through it to the outside. The end of the shaft 27.2 protruding to the outside is provided with an operating lever 27.6 which is secured in the central zero position thereof, for instance, by a bolt 29 which is thrust through corresponding holes in the bracket 28 and in the free end of the operating lever 27.6 by means of an approximately Z-shaped bracket 28 which is welded to the duct flange 23.1 on the outside.

The frame construction of the second embodiment example is somewhat different from that of the first example, in which connection reference is made particularly to FIGS. 5, 8 and 10. Angle-shaped holders 30 are welded by one leg 30.1 thereof to the inner periphery of the duct section 23, and specifically at the bottom side and at the side walls, so that the other leg 30.2 of the holders 30, protruding into the interior of the duct, forms a mounting plane for the support grid structure (plane eO—eO). The vertical struts A3, which have a U-shaped cross section with different leg lengths, are bolted by the base thereof to this mounting plane of the holders 30 (FIG. 10). The grid frame A2 is completed by the horizontal struts A4 which are connected to the upper and lower ends, respectively, of the vertical struts A3 in a manner not shown in detail, for instance, by bolting or welding. The lateral sides of the vertical struts A3, and specifically the longer U-leg thereof, in this manner, form mounting surfaces for the horizontal grid bars A9 which are screwed by the angled-off parts A9.1 of the ends thereof to the lateral sides of the vertical struts A3 (FIG. 10). The construction of the vertical struts A3 as U-sections permits the formation of lateral housing pockets or chambers 31 which can advantageously serve for receiving damping devices for the slats A15. For this case, the long U-leg of the vertical struts A3 is shortened somewhat so that the damping device can engage the end faces of the laminations A15 laterally.

The operation of the test device 27 is such that the knife-shaped adjusting organ 27.1 comes into engagement with the upper half of the slat array or panel by swinging the operating lever 27.6 upwardly and forces these slats into the closed position thereof. Since the lower, initially yet open half of the slat array or panel must then pass twice the amount of flow, the flow velocity is approximately doubled, and the head pressure increases so that the lower half of the slat array or panel also goes into the closed position if it functions properly. Similarly, the operability of the upper lamination half can be tested by swinging the knife-like adjusting member 27 into the lower closed position so that therefore a simple, reliably operating device is provided by the test device 27, by which the free running of the slats can be checked without any problem. This test, of course, takes only a short time and therefore virtually does not interfere with the operation, assuming that, as usual, several parallel-connected protective flaps are used.

FIG. 11 shows a third embodiment example of the slat support, wherein leaf springs B21 are structurally combined with the slats B15, and the slat-leaf spring unit B15–B21 is fastened to the support grid A5, with the end of a free leaf spring section B21.1, extending beyond the slat plane and forming a spring joint B24. In detail, an enlarged or bent-over leaf spring end B21.2 is held captive in slot shaped recesses B25 of grid bars A7, which extend transversely to the slats, by transverse pins B32 inserted into the slot-shaped recesses, partially surrounding them, the transverse pin B32 forming the joint axis about which the slat-leaf spring unit B15–B21 can be pivoted.

In the fourth embodiment example of a suitable slat support (see FIG. 12), the slats C15 are linked by joint eyes C33 formed by bending-over to joint pins C32 which are fixed to the support grid and extend parallel to the axis of the slats. The leaf spring C21, varying from the support according to FIGS. 4 and 9, is supported so that the end of the leaf spring C21.1 can slide on the slat C15 (sliding engagement) and the other leaf spring and C21.2 is fastened in a formed-locking manner in slots C34.1 of an additional vertical strip C34 which is firmly connected to the support grid. In the example according to FIG. 12, the slats C15 are further provided at the free long sides C15*o* thereof with parts C15.3 bent at an obtuse angle, with which they rest in the closed position thereof (shown at the top in FIG. 12) against the joint eyes C33 of the adjacent slat. These bent-off portions C15.3 could be omitted if the joint pins C32 were to extend parallel to the axis of the slats through slot-shaped recesses, as in the example according to FIG. 11.

A fifth embodiment example for a suitable slat support is shown in FIG. 13 as a detail, wherein the slats D15 are formed of a tough elastic plastic material and the slat joint is formed by a flexible slat skin D35 of reduced cross section which connects the lamination D15 proper to a fastening point D36 which is likewise fastened to the support grid in a slot-shaped recess D25. D9 are again the horizontal and D7 the vertical grid bars. Fastening can be facilitated by bumps D36.1 at the fastening part D36 and corresponding dimples in the wall of the slot-like recess D23 in the sense of an easily established snap-in connection.

Because the protective flap according to the invention responds relatively fast, measures for preventing fluttering in the case of a response are of particular importance. One important measure is that the slats 15, A15, and so forth are spring-loaded with a restoring force individually or by groups with different characteristics, so that, if a response occurs, they are transferred phase-shifted relative to each other into the closed position. In the case of the preferred use of leaf springs, as explained with the aid of the embodiment example, this measure can be realized relatively simply by the provision that leaf springs 21, A21, and so forth with different spring characteristics are coupled as restoring springs to the slats individually or in groups; the different spring stiffnesses thereof can be produced by varying the leaf-spring width i.e. the dimension of the leaf springs in the longitudinal direction of the slats. This is not shown in detail in the drawing but will be seen in a simple manner, for instance, by viewing FIG. 8 if one visualizes that the two leaf springs A21 shown there for the adjacent slat are made wider, or the number thereof is increased from 2 to 3, for instance. For the next-following slat the leaf spring arrangement and construction shown in FIG. 8 can then be used or a third leaf spring stiffness can be chosen so that (and this is the purpose of such a measure) not all slats close at the same time, but with phase shift from one slat to another or one group of slats to another. Thereby, the pressure reaction which would otherwise cause fluttering in the event of a sudden abrupt closing, cannot develop or at least not with a critical magnitude.

A further advantageous and effective measure which can be used in combination with the variation of the spring stiffness explained above, is shown in FIG. 14. Speaking generally, the objective is the generation of spring forces $P_F$ of defined magnitude engaging the lateral side of the slats A15, to produce friction damping at the slats A15 during the closing motion thereof. In detail, spring guide tracks A36 of approximately U-shaped cross section are arranged for this purpose at the vertical frame parts A3 of the support grid A5 adjacent the lateral slat sides A15.4 and facing them with the U-legs A36.1, A36.2 thereof. The spring guide track A36 furthermore has a fastening leg A36.3 by which it is connected and, in particular, screwed to the vertical frame part. At this spring guide track A36 there is supported a friction beam A37 of likewise approximately U-shaped cross section, so as to be movable in the longitudinal direction of the slats, the friction beam A37 facing with the flat bottom A37.0 thereof towards the lateral sides A15.4 of the slats. It is further guided in a sliding manner with the U-legs A37.1 and A37.2 thereof at the corresponding U-legs A36.1, A36.2 of the spring guide track A36. Between the spring guide and the friction beam A36, A37, respective spring elements A38 are arranged by which the friction beam A37 can be pressed on the entire length thereof with defined pressure against the lateral sides A15.4 of the slats A15. In the example shown, coil compression springs are used as the spring elements which, distributed over the length of the spring guide track A36, are supported in corresponding receptacle chambers A39. The receptacle chambers A39 can be formed, in the case of coil compression springs, by cylindrical or cup-shaped parts which are connected by spot welding, for instance, to the bottom of the spring guide track A36. It is easy in this manner to control the friction forces by the number and the spring stiffness of the spring element A38. Even if only the left end of a support grid with the slat is shown in FIG. 14, corresponding to the view in FIG. 10, it is understood that the damping arrangement according to FIG. 14 can also be related to the right-hand lateral side of the support grid and of the slat array or panel, so that a symmetrical "floating" arrangement is obtained which precludes jamming of the slats. Depending upon the pressure surges to be controlled during the operation, the measures of varying the spring stiffness in the slats individually or group-wise and the measures for damping the motion of the slats described with reference to FIG. 14 and specifically, either individually or in combination, are completely sufficient to prevent fluttering of the slats.

In special cases, if a very fast-responding protective flap is desired, the slat motion of which is not to be damped, a braking device according to FIG. 15, which can be used as a supplemental device in the first as well as in the second embodiment example can be of advantage. This concerns a braking device with at least one braking cross piece A40 which is supported so that it can be moved by means of a support cross piece A3.0 back and forth in the closed and open position of the slats A15 in accordance with the arrow A41 and touches, in the rest position R thereof (shown), the free longitudinal edges of the slats A15, and rests in the braking position thereof on the closed laminations over a large surface (see the circular arcs A42 about the pivots A43). The braking cross piece A40 has an effective area subjected to the pressure surge A22 such that it is put in the closed position together with the slats A15, means being provided to leave the braking cross piece A40 in the braking position thereof and for at least a period of 0.5 to several seconds in braking engagement. Advantageously, the braking cross piece A40 is linked for this purpose, via a dead-center transmission A44, to the frame structure A2 or to the support cross piece A3.0 connected thereto, and occupies a position beyond the dead center in the condition of braking engagement. To this end, the braking cross piece A40 is linked by means of a parallelogram linkage A45, in the example shown, to the support cross piece A3.0 arranged parallel to it. The junction points of the parallelogram linkage A45 with respect to the support cross piece are identified by A43 and those with respect to the braking cross piece by A43.1. At the fixed point A46, dead-center springs, constructed as coil tension springs A47, are suspended (shown only in the upper part of FIG. 15), and engage by the other end thereof with the linkage points A43.1 between the braking cross piece A40 and the parallelogram lever A45. In the closed position, the braking cross piece A40 occupies a position which is defined by the broken-line circular arcs, the junction point positions indicated at A43.1' and the braking cross piece contour shown in the broken line at A40'. The dead-center springs A47 keep the cross piece in the position thereof in this closed position, wherein the slats A15 are correspondingly closed; the braking cross piece A40 could then not attain the open position by itself and would have to be reset by hand. More advantageous, however, is automatic resetting by at least one time-delay A48 which, if the braking cross piece responds, is triggered and trips, at the end of the predetermined delay time, a power accumulator cocked by the closing motion of the braking cross piece for restoring the braking cross piece into the rest position thereof. Shown schematically is a time delay member A48 which may be a mechanically or mechanically/hydraulically operating timer in the manner of the automatic tripping device in photographic cameras. In the case shown, the braking cross piece A40 moves, in its closing motion, according to the arrow A49 towards the plunger A48.1 of the time delay member A48 and pushes this plunger into the housing of the time delay member A48 against the force of a power accumulator spring, whereby a delay mechanism arranged in this housing and tripped by this cocking process begins to run and, after the desired delay time, pushes the plunger A48.1 out of the housing again by means of the force of the power accumulator spring, so that the braking cross piece A40 moves against the force of the dead-center springs A47 beyond the dead center and can thereby be brought into the rest position R thereof automatically. For fastening this braking device, the stop strips A20 could be used (see, for instance, FIG. 6).

FIGS. 16 to 18 show some further support grid configurations and, specifically, FIG. 16 a support grid E5 which has only horizontal grid bars E9 within the frame E2; FIG. 17 shows a support grid F5 which has horizontal grid bars F9 and opposite thereto, grid bars F7 extending at an angle, forming rhombic grid panels within the the frame F2; and finally, FIG. 18 shows a support grid G5 within a frame G2 with rectangular or square concentrically extending grid bars G9 of a first group of bars and radially extending bars C7 of a second group of bars which cross this first group of bars. The invention is therefore not limited to the rectangular cross-grid configuration according to the first and second embodiment examples and also not horizontally and vertically extending grid bars even though this embodiment is preferred for practical reasons.

In conclusion it should be pointed out that in the embodiment examples described so far, the use of the protective flap or damper against pressure surges is taken as the basis, the direction of which coincides with the direction of the gaseous media flowing in normal operation through the open protective flap from the slats to the support grid (flow direction 22). Logically, however, the protective flap can also be used as a check valve, but then the gaseous media flowing in normal operation through the open flap in the opposite direction, namely, from the support group to the slats, hold the slats against the stops thereof, and the slats are movable against the support grid seats thereof by the reversed flow setting, in the case of trouble. Since the protective flap of the invention is an insertion part, as shown particularly in FIG. 3, this insertion part can be inserted either as shown, depending on the normal flow, into a duct section or can be inserted with interchanged sides. The protective flap according to the invention can therefore be used in many ways, thereby low-cost production is assured because of the large quantities of identical construction elements. A further construction important to the invention is characterized by the feature that further slats of the protective damper or flap are arranged on both sides of the supporting grid 7, 9 and A7, A9, respectively, i.e. also on the support grid 3 facing away from the laminations 15, A15, whereby a pressure wave protection function is then provided in both directions or, the one slat array or panel then acts as pressure wave protection and the other one as a check valve and vice versa. While this embodiment is not shown in the drawing, it follows directly from viewing FIG. 2 or FIGS. 5 and 9 if the slat arrays or panels 15 and A15, respectively, are visualized as mirrored about a protective grid symmetry plane normal to the flow or displaced with point symmetry to the other end face of the support grid. In principle, it is also possible to realize the idea of a dual protective pressure wave flap by connecting two support grids in tandem in the flow direction and a slat array or panel is associated with each support grid on the outside thereof or on the side thereof facing away from the adjacent support grid. The afore-mentioned construction of a dual protective pressure wave flap with only one support grid and one slat array or panel, respectively, side of the support grid pointing in the flow direction or opposite thereto is preferred, however, because of the more compact construction and savings in material.

We claim:

1. Shutter for protecting against pressure wave devices through which a gaseous or vaporous medium flows, the shutter having a frame structure and being formed of a multiplicity of slats pivotable about parallel axes in a common plane, the slats being maintained by restoring forces in an open position thereof and being braced against stops on the frame structure, the slats individually being formed of substantially planar strips, respectively, with opposite pairs of relatively long and short edges, the respective axes of the slats extending in direction and in vicinity of one of the relatively long edges thereof, and a supporting device disposed downstream of the slats in pressure surge direction of the medium and secured to the frame structure, the supporting device being formed of support elements disposed in a support raster and having a mutual division spacing matched to the width of the strips, the support elements having support locations thereon with which the slats are in engagement in a closed position thereof, the slats, in the open position thereof, being inclined away from the supporting device so that the free relatively long edges thereof are in engagement with the stops on the frame structure, the shutter further comprising a support grid forming the supporting device and covering the multiplicity of slats, said support grid including at least two groups of the support elements which are formed as grid bars, said groups of grid bars both extending in different directions, the grid bars of each of said two groups extending parallel to one another and having a plurality of the support locations thereon distributed over the entire length thereof, respectively, and engaged by the respective slats in the closed position thereof, and respective pretensioned leaf springs for generating torque about the respective pivot axes of the slats and applying restoring forces to the slats, on respective sides thereof facing towards said support grid, and in vicinity of the respective free, relatively long edges thereof, said leaf springs having, at one end thereof, a respective first force engagement point with the respective slats and, at the other end thereof, a respective second force engagement at a grid bar adjacent thereto, said leaf springs being fastened at one of said first and second force engagement points, and having a sliding seat at the other of said first and second force sliding seat at the other of said first and second force engagement points.

2. Shutter according to claim 1, wherein said grid bars are flat bars which are arranged on edge as seen in the pressure surge direction.

3. Shutter according to claim 1, wherein the grid bars of said two groups of grid bars cross each other at right angles.

4. Shutter according to claim 3, wherein said grid bars of said two groups of grid bars extend mutually crossed horizontally and vertically.

5. Shutter according to claim 1 wherein the grid bars of the grid bar groups are mutually engaged by means of slots and strips.

6. Shutter according to claim 4 wherein the horizontal grid bars (9) have a division spacing which corresponds to that of likewise horizontally extending slats (15) and the slots overlap each other in such a manner that their free hinged edges find support at the hinged support edge of the adjacent slat and at the associated horizontal grid bar in the closed condition of the flap.

7. Shutter according to claim 6 wherein the vertical grid bars (7) have a division spacing which is chosen as becoming smaller with increasing pressure loading of the slats and is approximately equal to the division spacing between the horizontal grid bars (9).

8. Shutter according to claim 7, wherein the support grid depth (10) of the horizontal grid bars (9) is equal or larger than the support grid depth of the vertical grid bar (7, 8).

9. Shutter according to claim 8, wherein, for forming surge diffusers, the horizontal grid bars have a dimension in the flow direction which is several times the width (a) of the narrowest flow cross section between adjacent slats (15) which corresponds to its smallest spacing in the open position.

10. Shutter according to claim 1, wherein the grid bars (7, 8, 9) are formed of metal, particularly of alloy steel, light metal or titanium.

11. Shutter according to claim 1, wherein, in order to obtain a gap-free surface of a support grid formed of mutually interleaved grid bars, the support grid is provided with a coating.

12. Shutter according to claim 1, wherein the slats are linked to the support grid in the vicinity of their long sides near the pivot axis in a multiplicity of joints distributed over their length.

13. Shutter according to claim 1, wherein the slats are angled-off at their long sides near the pivot axis and engage with the angled-off parts in slot-shaped recesses of grid bars extending transversely to the slats pivotally in a manner of a knife edge support.

14. Shutter according to claim 12, wherein the leaf springs are structurally combined with the slats and the slat/leaf spring unit is fastened to the support grid via the free leaf spring section extending beyond the slat area, forming a spring joint at the support grid.

15. Shutter according to claim 14, wherein each of said leaf springs is an enlarged or bent-over leaf spring end is held captive in slot-shaped recesses of grid bars extending transversely to the slate by transverse pins inserted into the slot shaped recesses, being partially looped around the latter and the transverse pin forming the axis of the joint, about which the slat/leaf spring unit is pivotable.

16. Shutter according to claim 12, wherein the slats are linked by shackles formed by beading-over, to hinge pins which are fixed to the support grid and extend parallel to the axis of the slats.

17. Shutter according to claim 16, wherein the shackles and pins are arranged in front of the support grid plane, and wherein the slats are provided at their free long sides with portions bent-off at an obtuse angle, with which they rest in their closed position against the shackles of the adjacent slat.

18. Shutter according to claim 12, wherein the slats are formed of tough and elastic plastic material and the slat joint is formed by a flexible slat skin of reduced cross section which connects the slat proper to a fastening part which is fastened to the support grid.

19. Flap according to claim 1, wherein the slats (15) are provided at their narrow sides in the vicinity of the long side (16) near their pivot axis, with support projections which point in the direction of the pivot axis and by which they are linked in the edge region of the support grid or immediately next to the support grid (5) engaging in support recesses of opposite frame parts of the frame structure, axially fixed.

20. Shutter according to claim 1, including by a test device with at least one knife-shaped adjusting member of low flow resistance which is oriented in the flow direction and is supported parallel to the axis of the slats and approximately central to the slat array on its pressure surge side tiltably in such a manner that the upper or lower side of the slat array can be closed by tilting the adjusting member in the one or other tilting direction.

21. Shutter according to claim 1, wherein the slats are spring-loaded individually or in groups with different characteristics with restoring action so that they get into the closed position in the case of a response, phase-shifted relative to each other.

22. Shutter according to claim 21 wherein said leaf springs have different spring characteristics and are coupled as restoring springs to the slats individually or in groups.

23. Shutter according to claim 22, wherein, in order to obtain different spring stiffnesses, the width of the leaf springs i.e. the dimensions of the leaf springs in the longitudinal direction of the slats, is variable.

24. Shutter according to claim 22, wherein the spring stiffness of the leaf springs is alternatingly larger or smaller from slat to slat.

25. Shutter according to claim 1, wherein said leaf springs are disposed so as to apply spring forces of defined magnitude engaging the lateral sides of the slats, for generating friction damping of the slats during their closing motion.

26. Shutter according to claim 25, including approximately U-shaped spring guide tracks arranged adjacent to the lateral slat sides and facing the latter with their U-legs at the vertical frame parts of the grid grating, at the spring guide tracks, approximately U-shaped friction bars of likewise approximately U-shaped cross section being supported movably in the lengthwise direction of the slats, which face with their flat bottom the lateral slat sides and are guided with their U-legs at the corresponding U-legs of the spring guide tracks in a sliding manner, and between the spring guide and friction track, respective spring elements being arranged, by which the friction bar can be pushed on its entire length against the lateral sides of the slat with defined contact pressure.

27. Shutter according to claim 26, wherein coil compression springs are used as the spring element which are supported in corresponding receptacle chambers distributed uniformly over the length of the spring guide track.

28. Shutter according to claim 1, wherein vertical stop strips firmly connected to the grid frame are arranged pointing in the flow direction with their narrow sides and in front of the slat array as seen in the pressure surge direction, and the stop strips are provided with saw-tooth stops corresponding to the tilted slat position in order to obtain a planar contact of the slat in their tilted open position.

29. Shutter according to claims 28 and 20, characterized by the feature that the stop strips serve for the rotatable support of the shaft of a knife-shaped adjusting member of a test device.

30. Shutter according to claim 1, including a braking device with at least one braking cross piece which is supported at the frame structure so as to be movable back and forth in the closed and open position of the slats, and which touches the free long edges of the slats in their rest position and rests flat on the closed slats in its braked position and which has an effective area subjected to the pressure surge such that it is moved into the closed position together with the slats, means being provided to leave the braking cross piece in its braking position in braking engagement for a period of at least 0.5 to several seconds.

31. Shutter according to claim 30, wherein the braking cross piece is linked via a dead-center transmission to the frame structure or a support cross piece connected thereto, and occupies a beyond-dead-center position in the state of the braking engagement.

32. Shutter according to claim 30, characterized by the feature that the braking cross piece is linked to the support cross piece arranged parallel to it by means of a parallelogram linkage.

33. Shutter according to claim 30, characterized by at least one time delay member which, if the braking cross piece responds, is triggered and, after the end of the predetermined delay time, triggers a power accumulator for restoring the braking cross piece to its rest position.

* * * * *